US008276399B2

(12) United States Patent
Maglinger

(10) Patent No.: US 8,276,399 B2
(45) Date of Patent: Oct. 2, 2012

(54) DOCKING STATION FOR A REFRIGERATOR

(75) Inventor: Frank Weston Maglinger, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 966 days.

(21) Appl. No.: 12/182,177

(22) Filed: Jul. 30, 2008

(65) Prior Publication Data

US 2009/0064705 A1 Mar. 12, 2009

Related U.S. Application Data

(60) Provisional application No. 60/971,790, filed on Sep. 12, 2007.

(51) Int. Cl.
*F25D 15/00* (2006.01)
*F25D 23/12* (2006.01)
*F25D 25/00* (2006.01)

(52) U.S. Cl. ..... 62/377; 62/331

(58) Field of Classification Search ..... 62/331, 62/377, 531

See application file for complete search history.

(56) References Cited

U.S. PATENT DOCUMENTS

| | | | | |
|---|---|---|---|---|
| 3,836,221 | A | 9/1974 | Whistler et al. | |
| 5,895,431 | A | 4/1999 | Miller et al. | |
| 6,644,046 | B2 | 11/2003 | Roh et al. | |
| 6,682,161 | B2 | 1/2004 | Yun | |
| 6,792,263 | B1 | 9/2004 | Kite | |
| 7,039,393 | B1 | 5/2006 | Kite | |
| 7,126,569 | B2 | 10/2006 | Ootsuka et al. | |
| 7,178,349 | B2 | 2/2007 | Roh et al. | |
| 7,224,962 | B1 | 5/2007 | Kite | |
| 7,227,498 | B2 | 6/2007 | Soliman | |
| 7,404,298 | B2 | 7/2008 | Kim et al. | |
| 7,430,111 | B2 * | 9/2008 | Lee et al. | 361/679.27 |
| 7,625,246 | B2 * | 12/2009 | McCoy et al. | 439/676 |
| 2003/0074912 | A1 | 4/2003 | Maeda | |
| 2004/0154318 | A1 | 8/2004 | Roh et al. | |
| 2004/0178710 | A1 | 9/2004 | Kim et al. | |
| 2004/0216471 | A1 * | 11/2004 | Kim et al. | 62/126 |
| 2005/0091996 | A1 | 5/2005 | Ishikawa et al. | |
| 2005/0138949 | A1 | 6/2005 | Jang et al. | |
| 2005/0231361 | A1 | 10/2005 | Godbey | |
| 2006/0021360 | A1 | 2/2006 | Kim et al. | |
| 2006/0118694 | A1 | 6/2006 | Lee et al. | |
| 2006/0237604 | A1 * | 10/2006 | Tan | 248/205.3 |
| 2006/0261220 | A1 * | 11/2006 | Lee et al. | 248/27.1 |
| 2007/0022645 | A1 | 2/2007 | Villarin | |

(Continued)

FOREIGN PATENT DOCUMENTS

DE 3616113 A1 * 12/1987

(Continued)

*Primary Examiner* — Frantz Jules
*Assistant Examiner* — Daniel C Comings
(74) *Attorney, Agent, or Firm* — Kirk W. Goodwin; McKee Vorhees & Sease

(57) ABSTRACT

The present invention provides a refrigerator having a docking station for holding electronic accessories tight against the door of the refrigerator. In one aspect of the present invention, the refrigerator includes a body having one or more doors, a docking station associated with the door, and having a receiving portion adapted to receive a module, and at least one spring associated with the docking station adapted to keep the docking station and the module flush against the door to eliminate variation and fit between the module and the door.

24 Claims, 12 Drawing Sheets

U.S. PATENT DOCUMENTS

| | | | | |
|---|---|---|---|---|
| 2007/0086151 | A1 | 4/2007 | Oh et al. | |
| 2007/0090254 | A1 | 4/2007 | Del Frari | |
| 2007/0126413 | A1 | 6/2007 | Oh | |
| 2007/0194187 | A1 | 8/2007 | Amron | |
| 2008/0165282 | A1 * | 7/2008 | Marcy et al. ..... | 348/552 |

FOREIGN PATENT DOCUMENTS

| | | |
|---|---|---|
| EP | 0985884 | 3/2000 |
| EP | 1152202 | 11/2001 |
| EP | 1450105 | 8/2004 |
| JP | 2001324258 | 11/2001 |
| JP | 2002243354 | 8/2002 |
| JP | 2003065659 | 3/2003 |
| JP | 2003302138 | 10/2003 |
| JP | 2003323232 | 11/2003 |
| KR | 20050059869 | 6/2005 |
| KR | 20050070958 | 7/2005 |
| KR | 20050075781 | 7/2005 |
| WO | 2004051164 | 6/2004 |
| WO | 2004083658 | 9/2004 |
| WO | 2005047786 | 5/2005 |
| WO | 2005057105 | 6/2005 |
| WO | 2006068456 | 6/2006 |

* cited by examiner

DOCKING STATION FOR A REFRIGERATOR

CROSS-REFERENCE TO RELATED APPLICATIONS

This application claims priority under 35 U.S.C. §119 of a provisional application Ser. No. 60/971,790 filed Sep. 12, 2007, which application is hereby incorporated by reference in its entirety.

FIELD OF THE INVENTION

The present invention relates to the field of refrigerators. More specifically, this invention provides a refrigerator having a docking station for holding an electronic accessory flush against the door of the refrigerator.

BACKGROUND OF THE INVENTION

The statements in this section merely provide background information related to the present invention and may not constitute prior art.

With the coming of age of electronic devices, users and operators alike seek for new ways to accommodate or implement these devices in many different settings or places. For example, it is well known that over time kitchens have evolved to incorporate various electronic devices, such as radios, CD players, under-cabinet mounted CD and DVD players and the like. Refrigerators now incorporate various electronic devices. For example, the refrigerator may be configured with a docking station having a power connector for modules to plug into a variety of devices, such as an iPod docking station, cell phone charging/hands-free station, TV, digital picture frames, Web tablet, message board, DVD systems, and the like. However, the streamline aesthetics of modem refrigerators require that the fit between the docking station and the refrigerator be commercially acceptable. This being said, due to manufacturing variations, unacceptable gaps between the door and the electronic device may result rendering the refrigerator commercially unacceptable and aesthetically displeasing. Thus, the need to limit or significantly reduce gaps between the door of a refrigerator and an electronic device attached at the docking station of the refrigerator is a design feature that the present invention provides a solution for by providing a refrigerator having a docking station for holding an electronic accessory flush against the door of the refrigerator. Location and/or placement of the docking station relative to the door is critical to keeping the module or electronic device flush with the refrigerator door. Even though prefabricated holes in the top of the door may be available for attachment of the docking station, positioning the docking station relative to the door using these holes creates too much variation in fit as these holes are fashioned in the doors before subsequent manufacturing processes such as bending, shaping, or forming the door. Therefore, there is a need in the art to provide a refrigerator having a docking station for holding an electronic accessory flush against the door of the refrigerator. Additionally, current manufacturing tolerances for modules or electronic devices may exhibit variances and must be also considered to keep a nominal gap between the module and/or electronic device and the refrigerator door. For example, many electronic devices and modules are often constructed or manufactured as multi-piece structures which add to the variation and possible gap between the door of the refrigerator and the module or electronic device. Therefore, there is a further need to solve this problem, as well.

BRIEF SUMMARY OF THE INVENTION

The present invention relates to a refrigerator having a docking station for holding an electronic accessory tight against the door of the refrigerator. In one aspect of the present invention, a refrigerator is disclosed. The refrigerator includes a body having one or more doors, a docking station associated with the door and having a receiving portion adapted to receive a module, and at least one spring associated with the docking station adapted to keep the docking station and the module flush against the door to eliminate variation in fit between the module and the door. In a preferred form, the refrigerator also includes a magnetically-active plate positioned within the door whereby one or more magnets fitted at a bottom portion of the module are adapted to keep the bottom portion of the module snug against the door. A pole shoe may be mounted across the magnets to increase holding power and concentrate magnetic flux to prevent interference with the module. An abutment located on the module is shaped to mate within the docking station where the spring presses against the abutment to urge the module against the door to eliminate variation of fit between the module and the door. The docking station defines a top surface with parallel edges terminating in a pair of side walls, whereby one edge also includes a pair of spring levers extending generally downward from the edge and generally outward from the side wall. The door of the refrigerator has a cover with an inner and outer surface, whereby at least one of the springs keeps the docking station flush against the inner surface and another spring keeps the module flush against the outer surface.

In another aspect of the present invention, a refrigerator is disclosed having a body with one or more doors and an exterior surface. A docking station is positioned at the top of the door having a receiving portion adapted to receive a module. At least one pair of spring levers associated with the docking station are adapted to keep the docking station and the module flush against the exterior surface of the door to eliminate variation and fit between the module and the door. In a preferred form, the refrigerator also includes the module having an abutment adapted to be mateably received within the docking station, whereby the at least one pair of spring levers press against the abutment to urge the module flush against the exterior surface of the door.

In yet another aspect of the present invention, a refrigerator is disclosed. The refrigerator includes a body having one or more doors with an exterior surface, a magnetically-active plate positioned behind the exterior surface of the door adapted to receive a module, and a magnet associated with the module to keep the module flush against the exterior surface of the door to eliminate variation in fit between the module and the door. In a preferred form, the refrigerator includes a docking station with sidewalls connected by a bottom wall to form a receiving portion, the bottom wall having a pair of upwardly extending spring levers and a module having an abutment with a front side and an opposite back side, whereby the pair of upwardly extending spring levers are in contact with the front side of the abutment to bias the back side of the abutment against one sidewall to draw the module up flush against the door where the module is docked in the receiving portion.

Further areas of applicability of the present invention will become apparent from the description provided herein. It should be understood that the description and specific examples are intended for the purposes of illustration only and are not intended to limit the scope of the present invention.

BRIEF DESCRIPTION OF THE DRAWINGS

The drawings described herein are for illustration purposes only and are not intended to limit the scope of the present invention in any way.

DETAILED DESCRIPTION OF THE PREFERRED EMBODIMENTS

The following description is merely exemplary in nature and is not intended to limit the present invention, application, or uses.

Figure 1A:
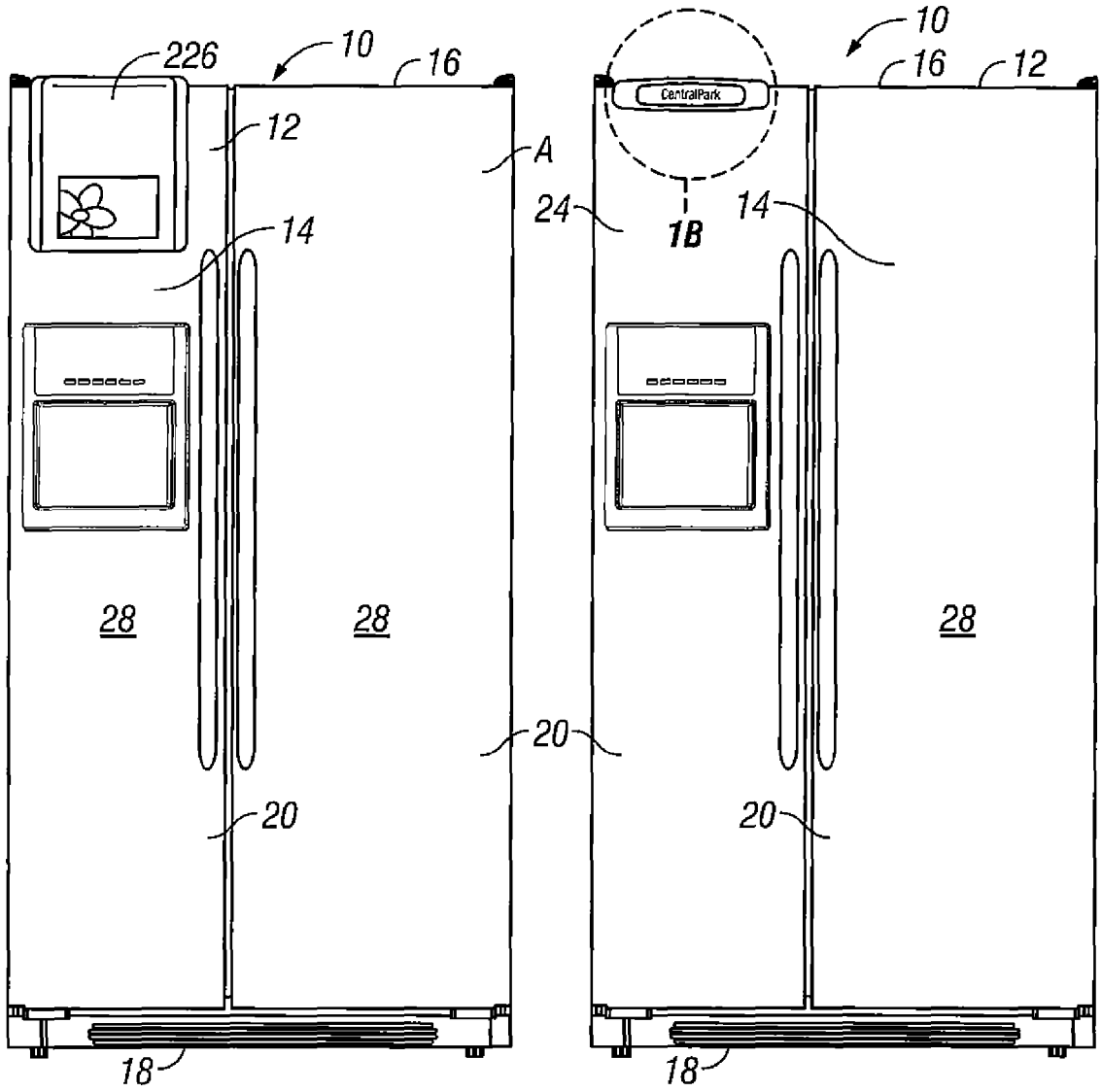
FIG. 1A shows a front elevation view of a pair of refrigerators according to an exemplary embodiment of the present invention.

The present invention provides a refrigerator having a novel docking station adapted to hold an electronic accessory and/or module tight against the door of the refrigerator. FIG. 1A illustrates a couple exemplary embodiments of the refrigerator 10 of the present invention. Generally speaking, the refrigerator 10 includes a refrigerator body 12 adapted to support one or more doors 14. Each door 14 has a top 16 and an opposite bottom 18. Door 14 also has a cover 24 which may be a door skin formed of a material such as plastic, stainless steel or the like. Each door 14 has an exterior side 20 and an opposite interior side 22. The exterior side 20 of the cover 24 of the door 14 has an inner surface 26 and an outer surface 28, as best illustrated in FIGS. 1A-2B. Similarly, the interior side 22 of the cover 24 of the door 14 also has an inner surface 26 and an opposite outer surface 28.

Figure 1B:
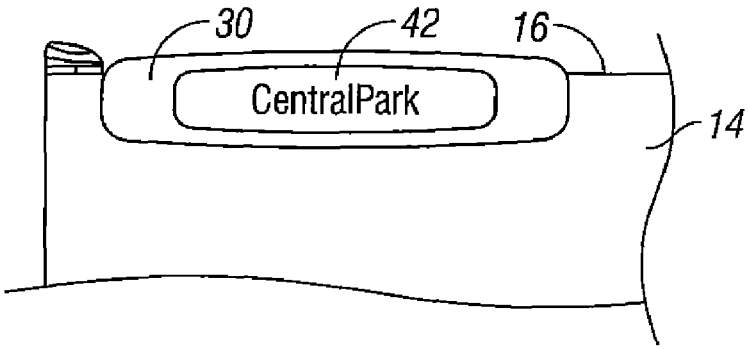
FIG. 1B is a sectional view taken along line 1B-1B in FIG. 1A.
Figure 1C:
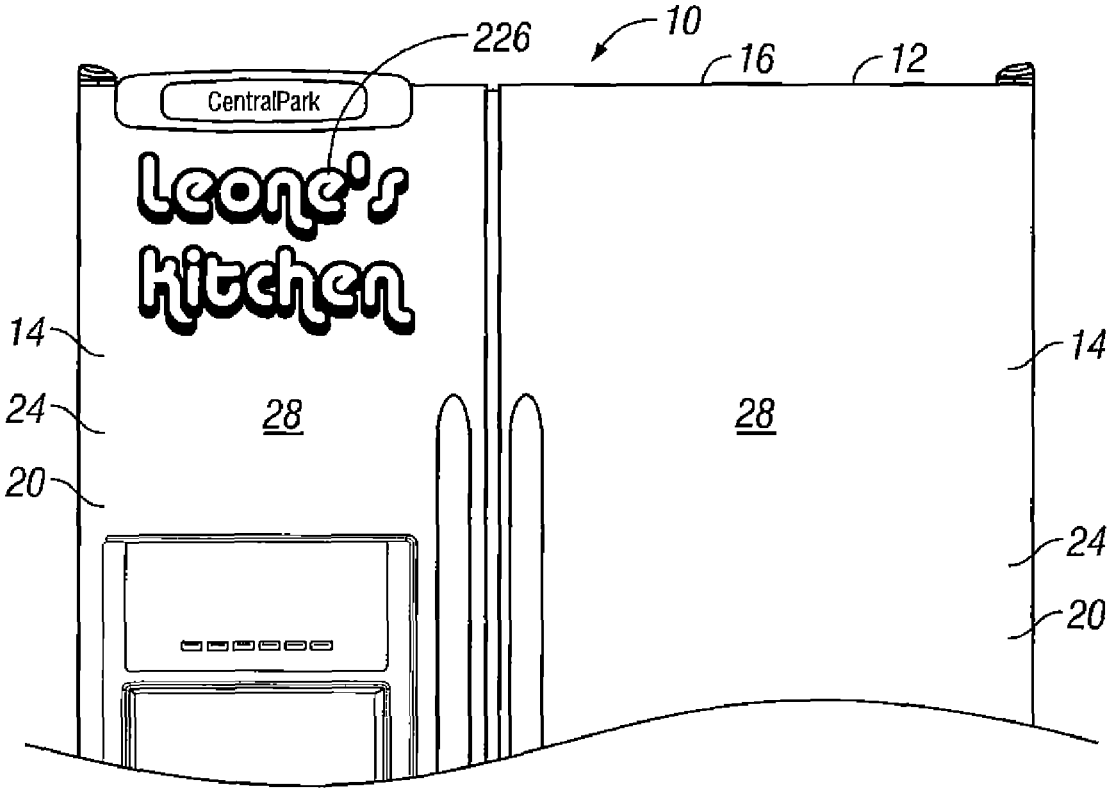
FIG. 1C is another embodiment of the electronic device shown in FIG. 1A.
Figure 10:
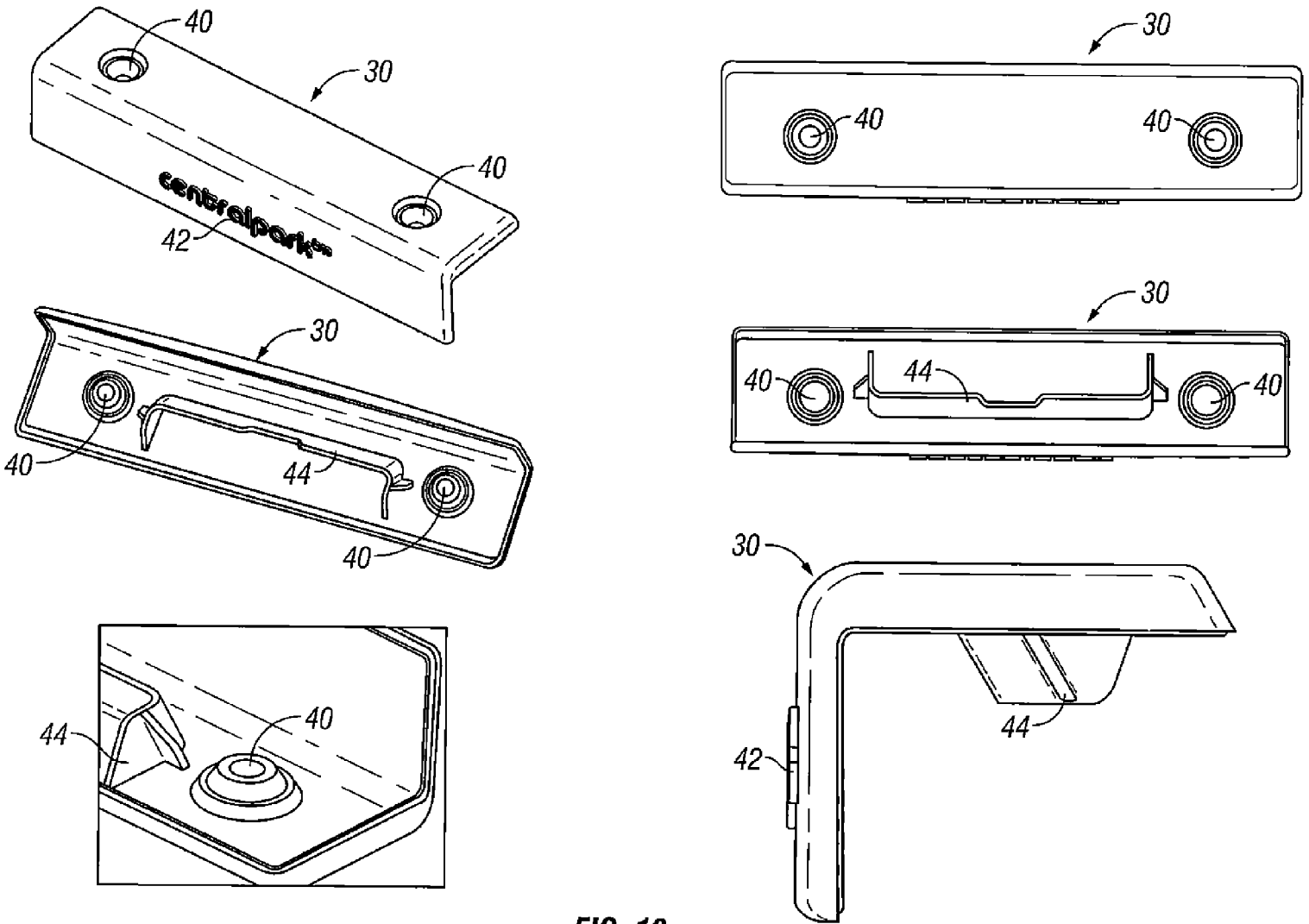
FIG. 10 is an illustration of several perspective views of the cap shown in FIGS. 1 and 1B according to an exemplary embodiment of the present invention.

Fashioned into the top 16 of the door 14 is a docking station 100, as best illustrated in FIGS. 2A-6A. The docking station 100 may be adapted to receive a cap 30, as shown in FIG. 1B, and FIG. 10 or an electronic device 226, as shown in FIGS. 1A and 1C. Even though the docking station 100 is shown on only one door 14 of the refrigerator 10, it should be appreciated by those skilled in the art that the docking station 100 could be fashioned into either one or both doors 14 of refrigerator 10.

Figure 2A:
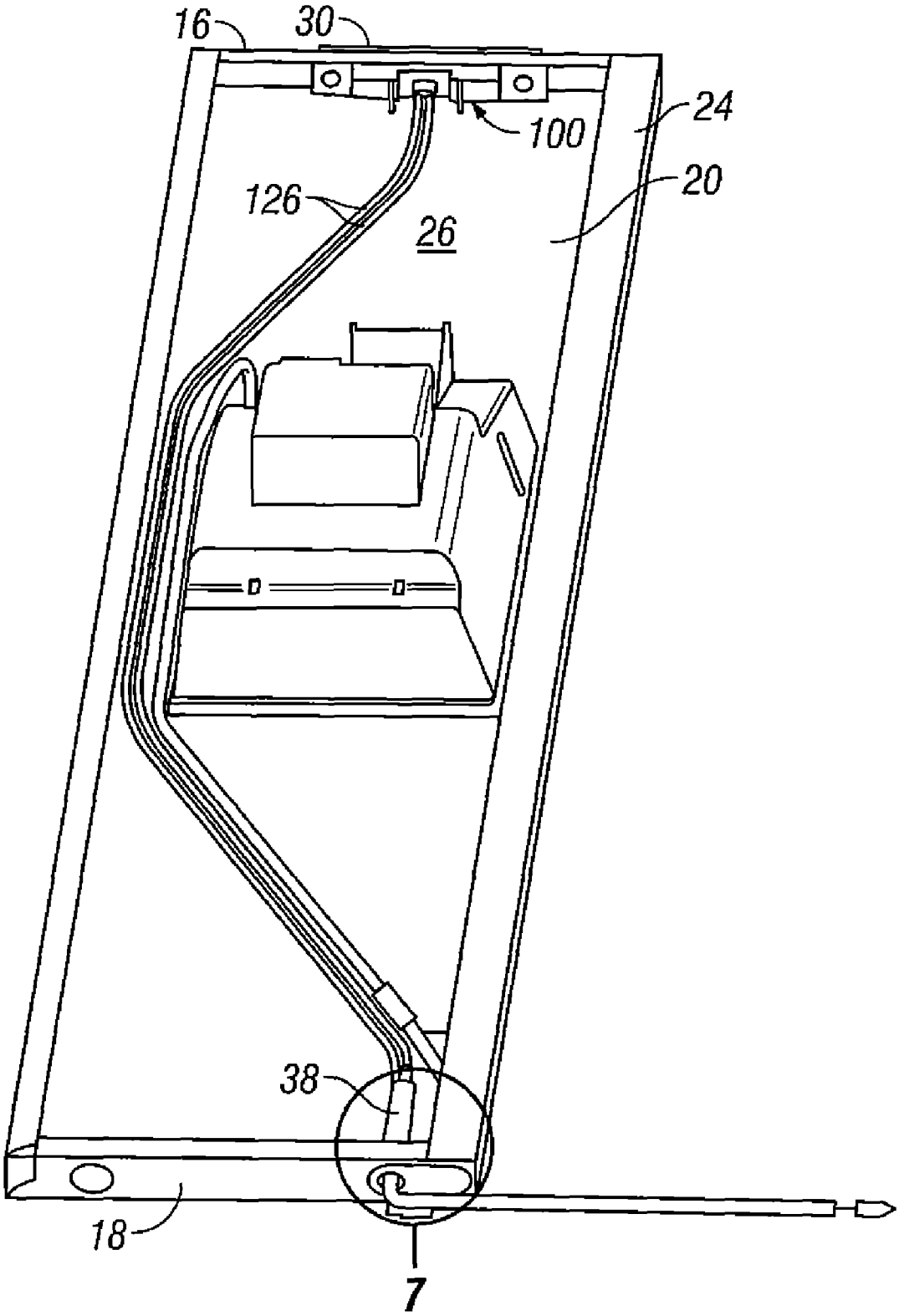
FIG. 2A is a perspective view of the inner surface of the exterior portion of the refrigerator door having a docking station and other exemplary auxiliary components.
Figure 2B:
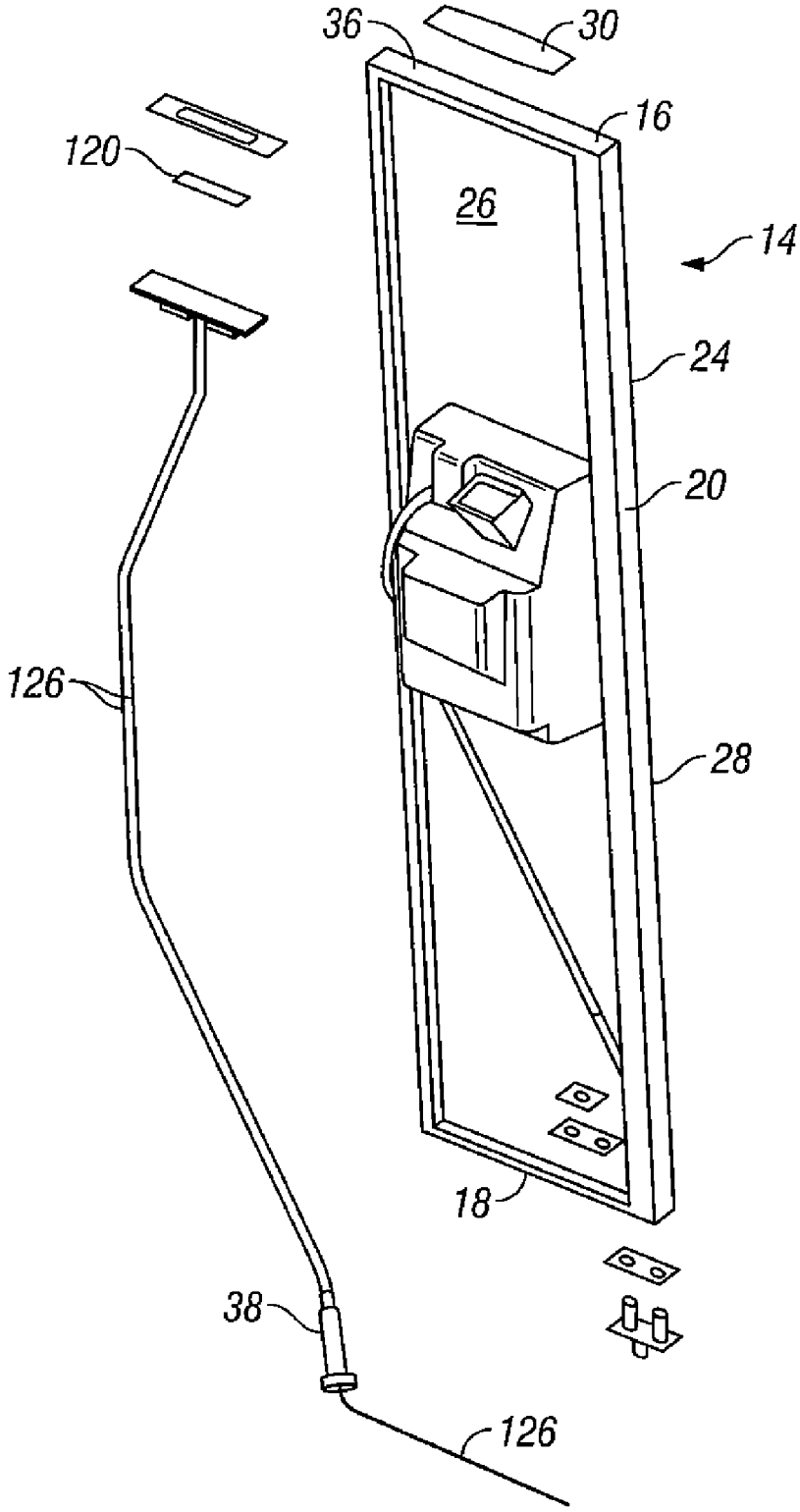
FIG. 2B is an exploded view of FIG. 2A.

FIGS. 2A and 2B best illustrate how the docking station 100 may be incorporated into the door 14 of the refrigerator 10. FIGS. 2A and 2B illustrate generally the inner surface 26 of the exterior side 20 of the door 14. Positioned at the top 16 of the door 14 is docking station 100. A pair of wires 126 ingress door 14 at bottom 18 by way of adapter 38. In one aspect of the present invention, adapter 38 may be a cam adapter whereby the adapter is rotated or twisted to lock the position of the adapter 38 relative to the bottom 18 of the door 14. Wires 126 extend from the adapter 38 up to the docking station 100. Wires 126 may be configured to provide power at the docking station 100 and/or transfer an electrical signal from or to the docking station 100.

Figure 3:
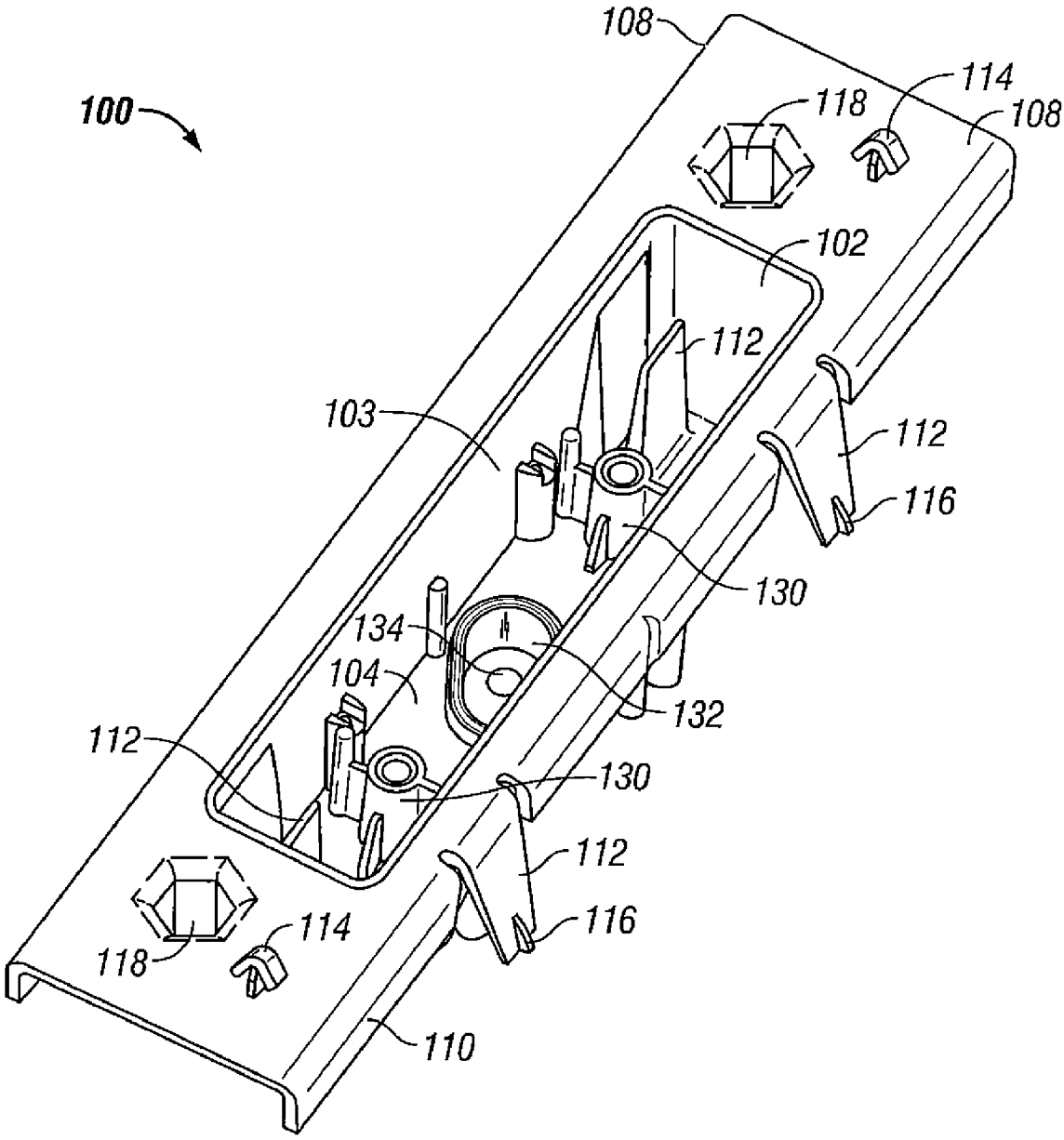
FIG. 3 is an isometric view of the docking station according to an exemplary embodiment of the present invention.
Figure 4:
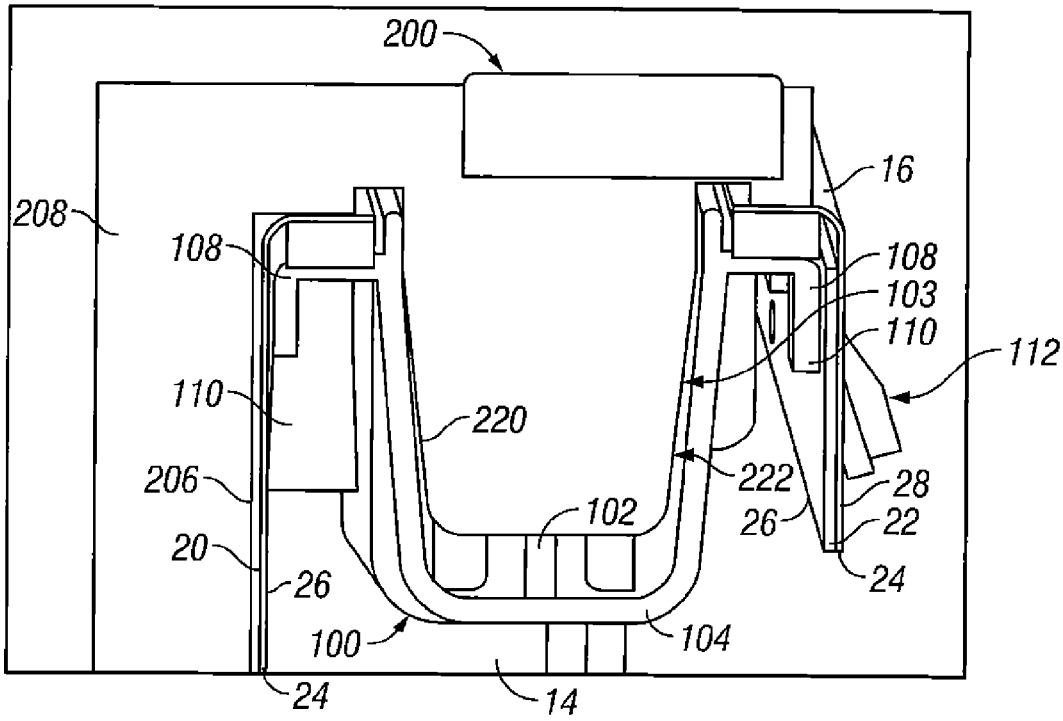
FIG. 4 is a partial sectional view of the docking station and module positioned in the refrigerator door according to an exemplary embodiment of the present invention.

FIG. 3 shows a perspective view of one embodiment of the docking station 100 according to an exemplary aspect of the present invention. The docking station 100 in one aspect has a generally u-shaped member supporting a receiving portion 102. The u-shaped member has a top surface 106 with opposite parallel edges 108 terminating in sidewalls 110. Each sidewall 110 extends in a generally perpendicular direction away from the top surface 106 of the docking station 100. A pair of spring levers 112 is configured into at least one sidewall 110. The spring levers 112 extend in a generally downward direction from edge 108 and in a generally outward direction from sidewall 110 so as to be angled away from sidewall 110. Each spring lever 112 positioned in sidewall 110 of the docking station 100 may also include a catch 116. Spring levers 112 configured into the sidewall 110 of the docking station 100 contact the inner surface 26 of the interior side 22 of the cover 24 of the door 14, as best illustrated in FIG. 4. The pressure of spring lever 112 configured into the sidewall 110 of the docking station 100 acting on the inner surface 26 of the interior side 22 of the cover 24 of the door 14 biases the opposite sidewall 110 against the inner surface 26 of the exterior side 20 of the cover 24 of the door 14. Thus, spring lever 112 configures into the sidewall 110 of the docking station 100 insures that the docking station 100 is correctly positioned within and relative to the door 14.

Figure 5:
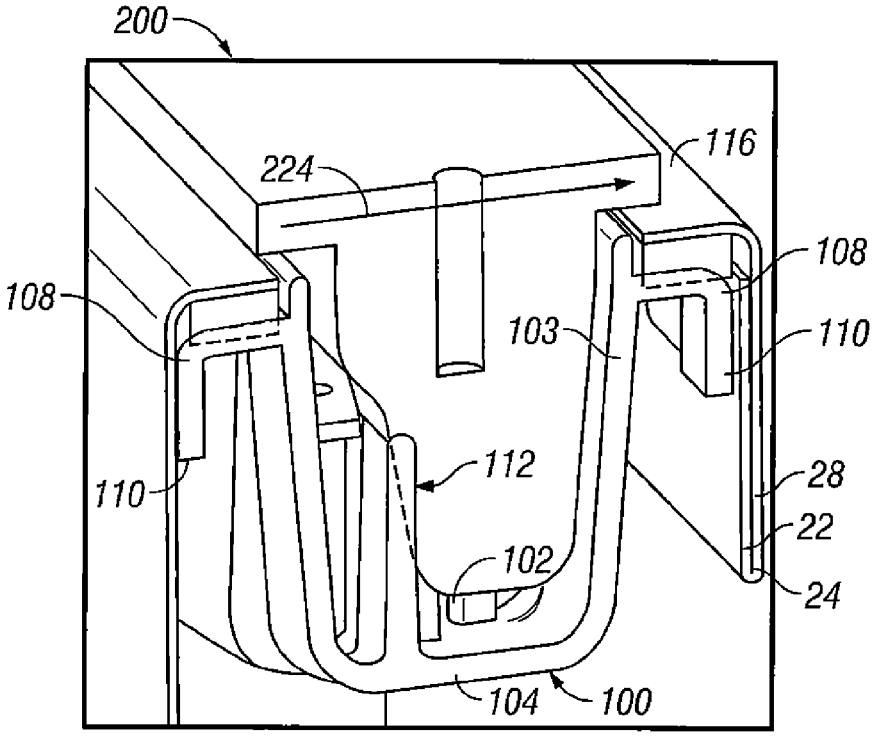
FIG. 5 is another partial cross-sectional view of the module and docking station mounted within the refrigerator door according to an exemplary embodiment of the present invention.
Figure 6A:
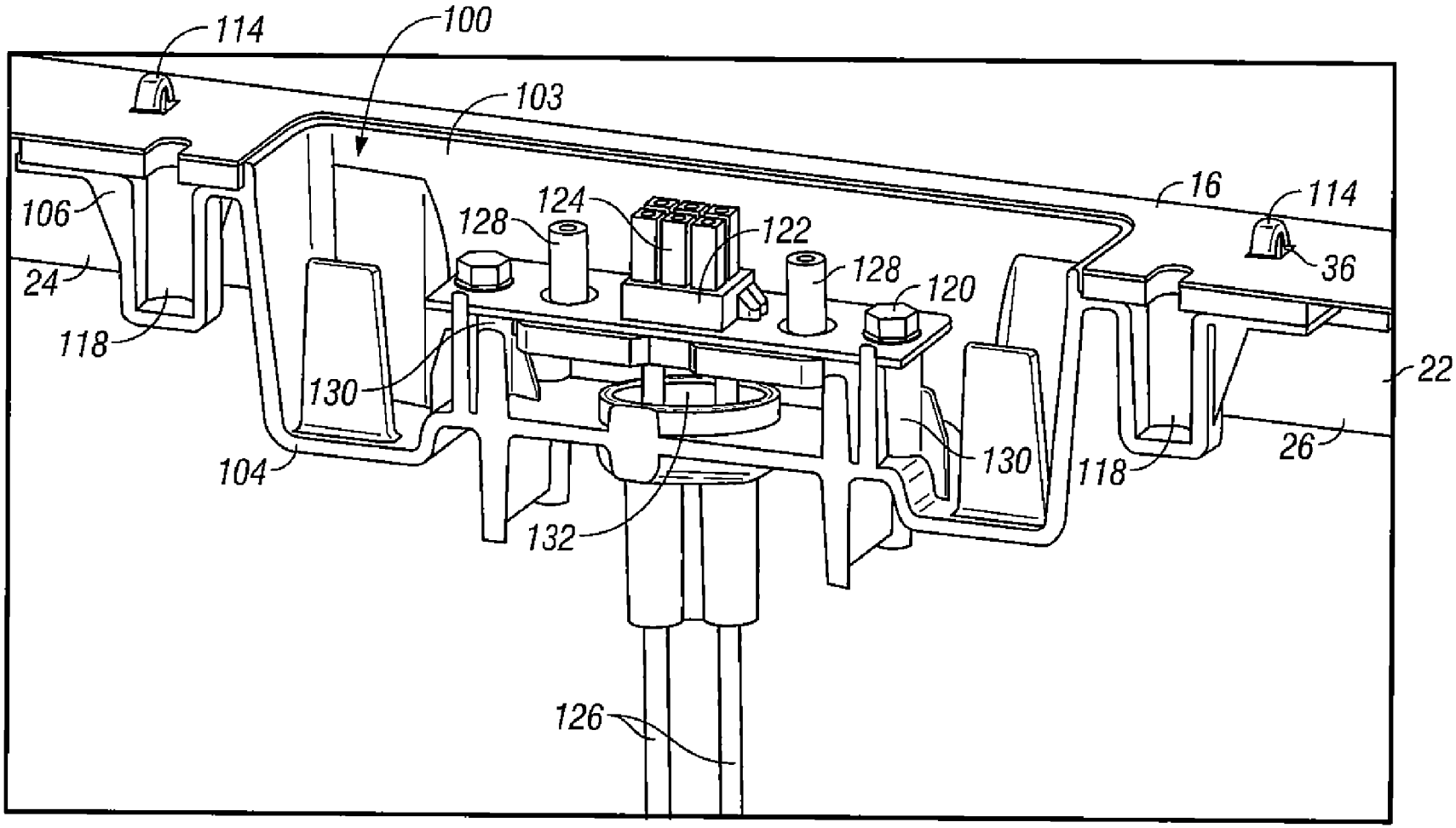
FIG. 6A is a front elevation, partial sectional view of the docking station mounted within the refrigerator door according to an exemplary embodiment of the present invention.
Figure 6B:
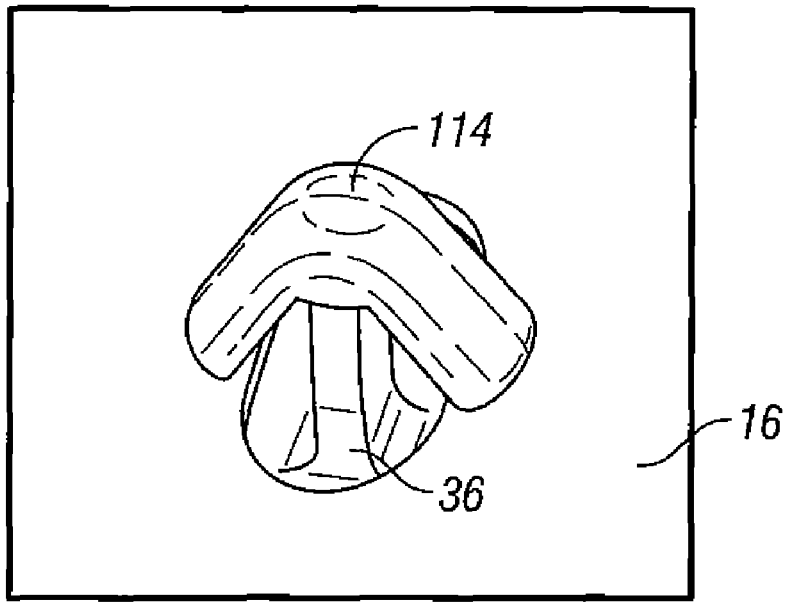
FIG. 6B is an isometric view of a snap of the docking station according to an exemplary embodiment of the present invention.
Figure 7:
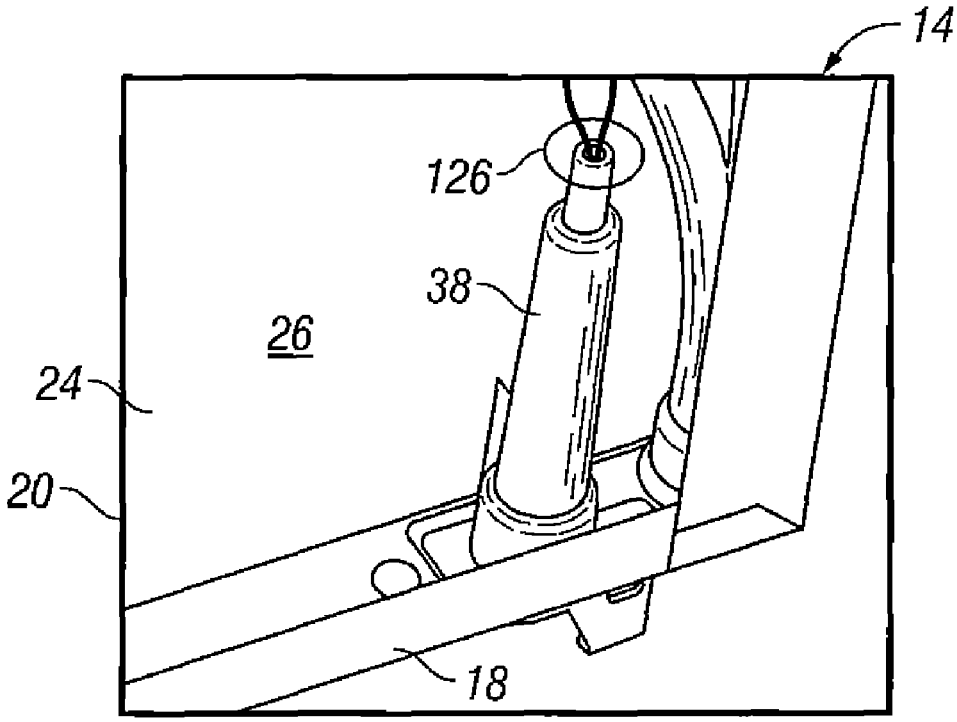
FIG. 7 is an isometric view of an adapter positioned at the bottom portion of the refrigerator door taken along line 7-7 in FIG. 2A.

In another aspect of the docking station 100, the docking station 100 includes a receiving portion 102 formed by a plurality of sidewalls 103 attached to a bottom wall 104. The receiving portion 102 of the docking station 100 is cup-shaped and thereby adapted to house, receive, and mate with a top portion 208 of the module 200. Positioned on the bottom wall 104 of the docking station 100 is a pair of upwardly extending spring levers 112. Spring levers 112 extend upwardly from the bottom wall 104 of the docking station 100 in a generally perpendicular direction. Each spring lever 112 has a larger cross-sectional area at its base, which tapers to a smaller cross-sectional area at its tip. As shown in FIG. 5, spring lever 112 extending from the bottom wall 104 of the docking station 100 is configured to contact and apply pressure to the front side 220 of each abutment 214 of the module 200. Thus, spring lever 112, shown in FIG. 5, biases or urges the back side 222 of the abutment 214 against the sidewall 103 of the docking station 100 by shifting or urging the docking station 100 rearward along arrow 224. The biasing or urging of the module 200 rearward against the sidewall 103 of the docking station 100 causes the back side 206 of the module 200, shown in FIGS. 8A and 8B, to be pulled up flush against the outer surface 28 of the exterior side 20 of the cover 24 of the door 14, as best illustrated in FIG. 4. Thus, both sets of spring levers 112 (i.e., spring lever 112 extending upwardly from the bottom wall 104 of the docking station 100 and spring levers 112 extending from the edge 108 of the top surface 106 of the docking station 100) help to correctly position the docking station 100 within and relative to the door 14 as well as correctly position the module 200 relative to the docking station 100 and the outer surface 28 of the exterior side 20 of the cover 24 of the door 14. Also, configured into the bottom wall 104 of the docking station 100 is a pair of posts 130. Posts 130 are used to secure mounting plate 120 to the bottom wall 104 of the docking station 100, as best illustrated in FIG. 6A. A recess 132 having an aperture 134 is also configured into the bottom wall 104 of the docking station 100, as shown in FIGS. 3 and 6A. Wires 126 pass through the aperture 134 and the recess 132 of the docking station 100. These wires 128 are connected to a connector 122 mounted in the mounting plate 120. Connector 122 has a plurality of contact pins 124 adapted to mate with connector 218 of the module 200. The connector 122 may be rigidly fixed to the mounting plate 120 or floatably connected to the mounting plate 120 whereby the connector 122 may shift accordingly to mate with connector 218 of the module 200. Alignment pins 128 may also be used to help align connector 218 of the module 200 with connector 122 of the docking station 100. Several other features configured into the top surface 106 of the docking station 100 are used for connecting the docking station 100 to the top 16 of the door 14. For example, snaps 114 positioned on the top surface 106 of the docking station 100 extend through apertures 36, as best illustrated in FIG. 2B, in the top 16 of the cover 24 of the door 14 to help secure the docking station 100 to the door 14. Additionally, cavities 118 may be configured into the top surface 106 of the docking station 100 for receiving a coupler nut (not shown) that extends through an aperture in the top 16 of the cover 24 of the door 14 to aid in securing the docking station 100 to the door 14, as best illustrated in FIGS. 3 and 6A.

Figure 8A:
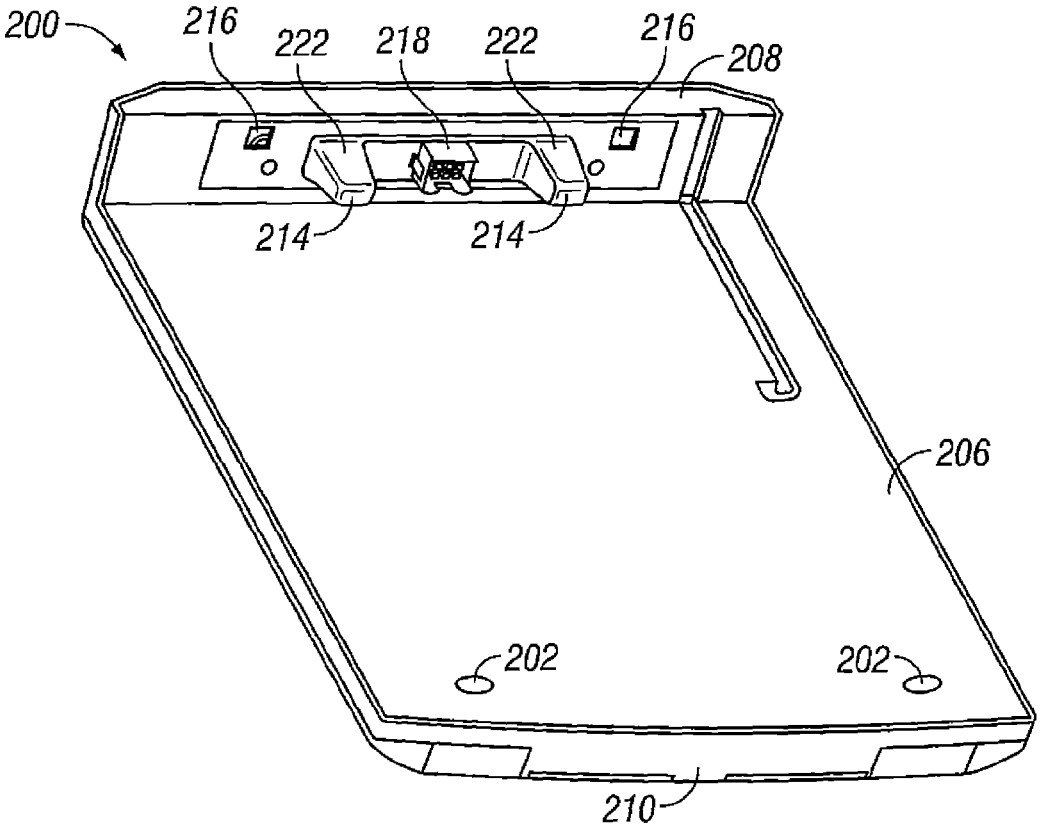
FIG. 8A is a perspective view of the module according to an exemplary embodiment of the present invention.
Figure 8B:
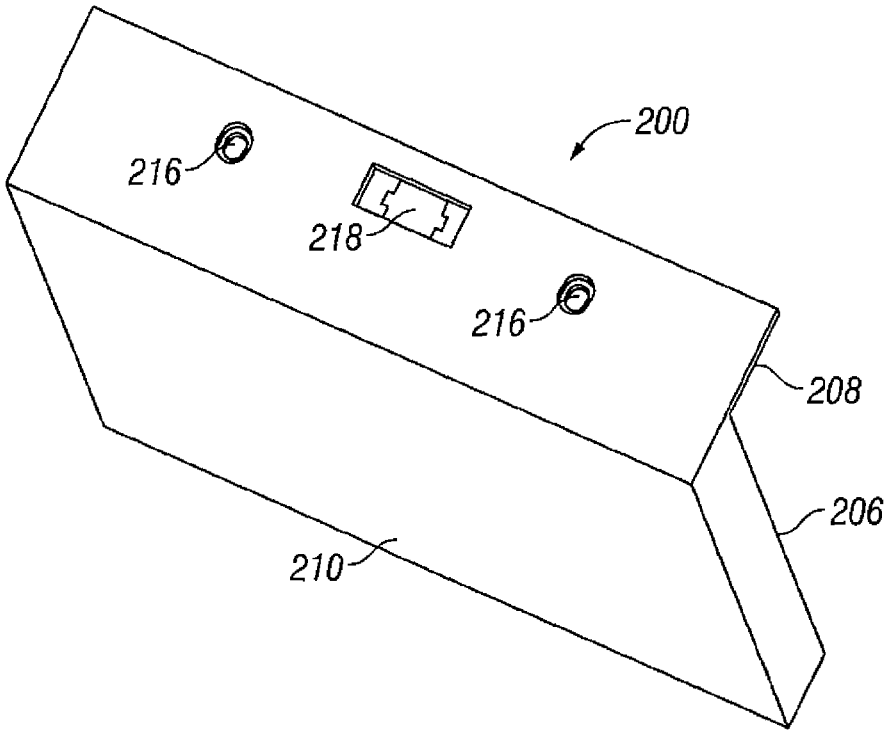
FIG. 8B is a perspective view of another embodiment of the module shown in FIG. 8A.
Figure 9A:
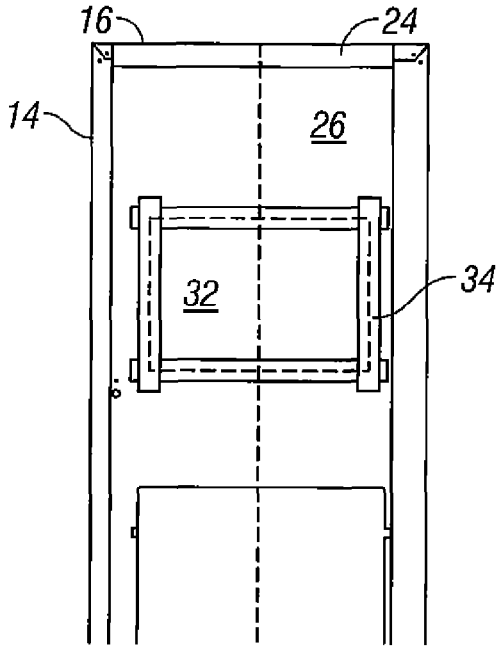
FIG. 9A is an elevation view of the magnetic plate positioned on the inner surface of the exterior portion of the door according to an exemplary embodiment of the present invention.
Figure 9B:
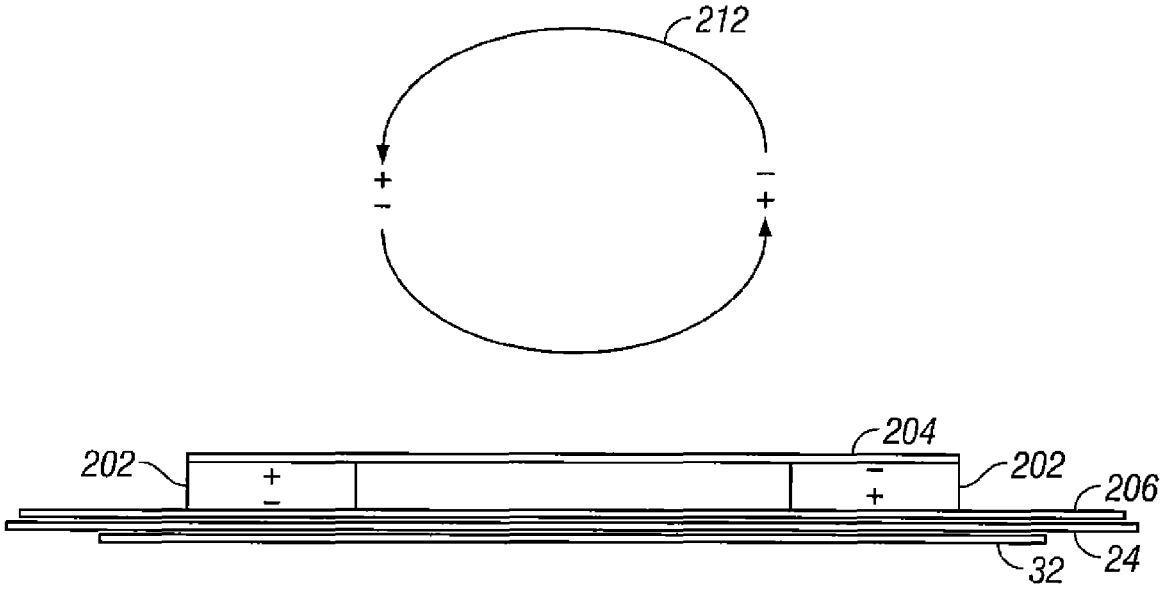
FIG. 9B is a sectional view of the magnetic plate and door shown in FIG. 9A.
Figure 11A:
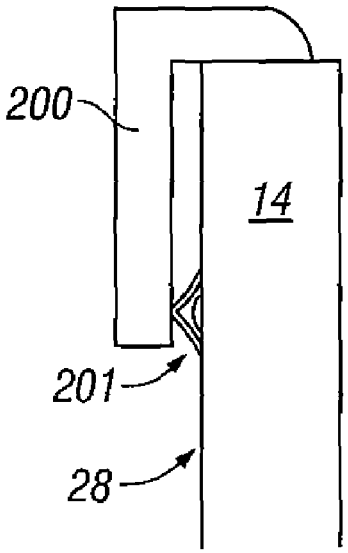
FIGS. 11A-11C are side views showing alternative embodiments of the invention.
Figure 11B:
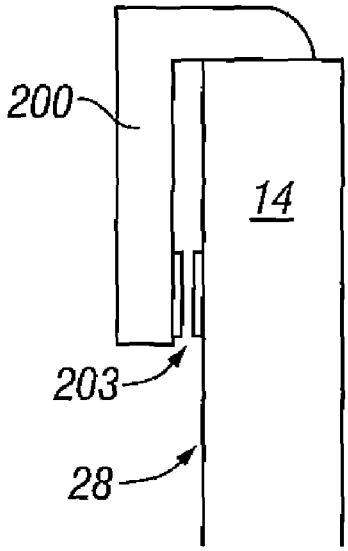
Figure 11C:
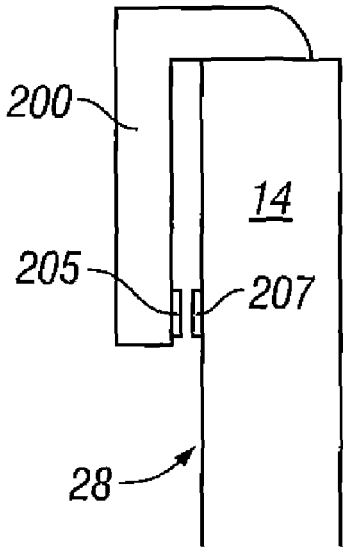

FIGS. 8A and 8B best illustrate the module 200 according to an exemplary embodiment of the present invention. The module 200 has a top portion 208 and an opposite bottom portion 210. As previously discussed, the module 200 has a pair of abutments 214 extending in a generally perpendicular direction from the top portion 208 of the module 200. A connector 218 is also configured into the top portion 208 of the module 200. Connector 218 mates with connector 122 in the docking station 100 when the module 200 is docked within the docking station 100. Similarly, the back side 222 of each abutment 214 is urged rearward against the sidewall 103 of the docking station 100 by a spring lever 112 acting on the front side 220 of the pair of abutments 214, as shown in FIG. 5. Apertures 216 are configured into the top portion 208 of module 200 to aid in securing the module 200 to the docking station 100 when the module 200 is docked within the docking station 100. As also previously mentioned, the pair of abutments 222 acted on by the pair of spring levers 112 extending upwardly from the bottom wall 104 of the docking station 100 help to draw the top portion 208 of the back side 206 of the module 200 up flush against the outer surface 28 of the exterior side 20 of the cover 24 of the door 14. To aid in drawing the bottom portion 210 of the module 200 up flush against the outer surface 28 of the door 14, a corresponding pair of fasteners 205, 207 may be positioned in or on the bottom portion 210 of the module 200 and on the door 14, as best shown in FIG. 11 C. Preferably one or more magnets 202 may be positioned in the module 200, and a magnetically-active medium such as plate 32, shown in FIG. 9A, may be positioned on the inner surface 26 of the exterior side 20 of the cover 24 of the door 14. Plate 32 may be any type of material that is magnetically-active, such as a ferrous metal and may be attached by way of adhesive 34. Plate 32 provides a magnetically-active medium for each magnet 202 in module 200 to be attracted to. For example, if the cover 24 of the door 14 is a stainless steel material, plate 32 provides a magnetically-active member for magnets 202 on the module 200 to be attracted to draw the bottom portion 210 of the module 200 up flush against the outer surface 28 of the door 14. In another aspect of the present invention, the magnets 202, as shown in FIG. 9B, may include a pole shoe 204 connected across the pair of magnets 202 to increase the holding power and concentrate magnetic flux 212 so that it is less likely to interfere with module 200. While magnets 202 are preferred to aid in drawing the bottom portion 210 of the module 200 up flush against the outer surface 28 of the door 14, it is recognized that other fastening devices such as suction cups 201, hook-and-loop fasteners 203 such as Velcro® or any other fastening device could be used, as shown in FIGS. 11A and 11B. Furthermore, module 200, as shown in FIGS. 1A, 1C, 8A, and 8B, may be any electronic device 226 capable of being connected to the module 200 or docked within the docking station 100 of the present invention. For example, a variety of devices such as an iPod docking station, cell phone charging/hands-free station, TV, digital picture frame, Web tablet, message board, DVD system, and the like may be connected to the module 200 and/or docked within the docking station 100 of the present invention. By way of further example, FIGS. 1A and 1C show the electronic device 226 being an LCD panel and neon sign, respectively. Although several examples of electronic devices are disclosed, these electronic devices 226 are used only by way of example, as the docking station 100 and the module 200 may be configured to accommodate a wide variety of various electronic devices not limited to any specific use, scope, or application.

FIG. 10 shows various views of a cap 30 of the present invention. Cap 30 is a generally L-shaped member adapted to insert within and cover the docking station 100 of the present invention. Cap 30 may include recessed apertures 40 whereby a locking nut may be inserted through each recess aperture 40 and the cap 30 into one of the cavities 118 in the top surface 106 of the docking station 100 to secure the cap 30 to the door 14 of the refrigerator 10. An abutment 34 may also be configured into the cap 30 to help in correctly positioning the cap relative to the docking station 100 and/or the door 14. For example, the abutment 44 may be received within the receiving portion 102 of the docking station 100 to help align the cap 30 relative to the docking station 100 and the door 14 of the refrigerator 10, as shown in FIG. 1A. The cap 30 may further include indicia 42, such as raised lettering, on a surface on the cap 30, as shown in FIGS. 1A and 10.

The description of the disclosure is merely exemplary in nature and, thus, variations that do not depart from the gist of the disclosure are intended to be within the scope of the disclosure. Such variations are not to be regarded as a departure from the spirit and scope of the disclosure. Changes in the formed proportions of parts, as well as in substitutions of equivalents are contemplated as circumstances may suggest or are rendered expedient without departing from the spirit and scope of the invention as further defined in the following claims.

What is claimed is:

1. A refrigerator comprising:

a body having a door defining a front face bound by a peripheral edge including a topmost edge; and a docking station comprising:

a receiving portion provided in the topmost edge and adapted to receive at least a portion of a module within the door, the receiving portion having at least one wall; and at least one spring provided in the receiving portion and adapted to bias the at least a portion of the module toward the at least one wall.

2. The refrigerator of claim 1 further comprising at least one fastener positioned on the front face of the door and adapted to couple with a corresponding fastener on the module.

3. The refrigerator of claim 2 wherein the at least one fastener is one of a hook fastener and a loop fastener and the corresponding fastener is the other of a hook fastener and a loop fastener.

4. The refrigerator of claim 2 wherein the at least one fastener is one of a suction cup and a surface capable of receiving a suction cup and the corresponding fastener is the other of a suction cup and a surface capable of receiving a suction cup.

5. The refrigerator of claim 2 wherein the at least one fastener is one of a magnetically active plate and at least one magnet and the corresponding fastener is the other of a magnetically active plate and at least one magnet.

6. The refrigerator of claim 5 wherein the at least one magnet comprises a pair of magnets, and further comprising a pole shoe mounted across the pair of magnets.

7. The refrigerator of claim 1 wherein the receiving portion is cup-shaped and includes a bottom wall attached to the at least one wall, and the at least one spring comprises a first pair of spring levers extending upward from the bottom wall.

8. The refrigerator of claim 1 wherein the module has an abutment shaped to mate within the docking station whereby the at least one spring presses the abutment toward the at least one wall.

9. The refrigerator of claim 7 wherein the docking station further comprises a top surface having parallel edges terminating in a pair of sidewalls, whereby one edge further comprises a second pair of spring levers extending generally downward from the edge and generally outward from the sidewall.

10. The refrigerator of claim 9 wherein the second pair of spring levers push against an interior of the door to bias the docking station toward an exterior of the door.

11. The refrigerator of claim 1 wherein the door further comprises an inner surface and the docking station further comprises at least one second spring which biases the docking station against the inner surface.

12. The refrigerator of claim 1 wherein the docking station is adapted to be positioned relative to the door by at least one snap adapted to enter the door and/or the module.

13. The refrigerator of claim 12 wherein the module has an aperture adapted to mate with the at least one snap on the docking station to secure the module to the docking station.

14. The refrigerator of claim 1 wherein the docking station further comprises at least one cavity adapted to receive a pin to secure a cap to the docking station.

15. The refrigerator of claim 1 wherein the docking station further comprises a mounting plate adapted to floatably house a connector having contact pins, whereby the contact pins in the connector are mateably received in the module when docked in the docking station.

16. The refrigerator of claim 15 wherein the connector is a power connector adapted to provide power to the module.

17. The refrigerator of claim 1 wherein the module is an electronic device.

18. The refrigerator of claim 17 wherein the electronic device is one of a portable media player docking station, a cell phone charging/hands-free docking station, a TV, a digital picture frame, a Web tablet, a message board, and a DVD system.

19. A refrigerator comprising:

a body having a door with an exterior surface and a topmost edge;

a docking station comprising:

a receiving portion provided in the topmost edge and adapted to receive at least a portion of a module within the door, the receiving portion having at least one wall; and at least one pair of spring levers associated with the docking station and adapted to bias the module toward the at least one wall and keep the module flush against the exterior surface of the door.

20. The refrigerator of claim 19 wherein the at least one pair of spring levers is positioned within the receiving portion.

21. The refrigerator of claim 19 further comprising at least one second pair of spring levers positioned outside the docking station to keep the docking station flush against an inner sidewall of the exterior surface of the door.

22. The refrigerator of claim 19 wherein a ferrous metal plate is positioned behind the exterior surface of the door.

23. The refrigerator of claim 22 wherein the module has one or more magnets attracted to the ferrous metal plate to urge the module flush against the exterior surface of the door.

24. The refrigerator of claim 19 wherein the module further comprises an abutment adapted to be mateably received within the receiving portion, whereby the at least one pair of spring levers press against the abutment to bias the module toward the at least one wall.

* * * * *